US008491413B2

(12) United States Patent
Billings

(10) Patent No.: US 8,491,413 B2
(45) **Date of Patent: *Jul. 23, 2013**

(54) CUSTOMIZABLE CENTER-OF-GRAVITY GOLF CLUB HEAD

(75) Inventor: David P. Billings, McKinney, TX (US)

(73) Assignee: Dogleg Right Corporation, Plano, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/470,268

(22) Filed: May 12, 2012

(65) Prior Publication Data

US 2012/0225733 A1 Sep. 6, 2012

Related U.S. Application Data

(63) Continuation of application No. 11/467,139, filed on Aug. 24, 2006, now Pat. No. 8,177,662, and a continuation of application No. 11/313,137, filed on Dec. 20, 2005, now Pat. No. 7,189,169, and a continuation of application No. 10/043,421, filed on Jan. 10, 2002, now Pat. No. 7,004,852.

(51) Int. Cl.
*A63B 53/04* (2006.01)

(52) U.S. Cl.
USPC ..... 473/332; 473/334; 473/335; 473/338; 473/339; 473/345; 473/349

(58) Field of Classification Search
USPC ..... 473/324–350, 287–292, 256
See application file for complete search history.

(56) References Cited

U.S. PATENT DOCUMENTS

| | | | | |
|---|---|---|---|---|
| 7,004,852 | B2 * | 2/2006 | Billings | 473/332 |
| 7,189,169 | B2 * | 3/2007 | Billings | 473/332 |
| 7,344,450 | B2 * | 3/2008 | Billings | 473/324 |
| 7,828,672 | B2 * | 11/2010 | Billings | 473/332 |
| 8,177,662 | B2 * | 5/2012 | Billings | 473/332 |

* cited by examiner

*Primary Examiner* — Sebastiano Passaniti
(74) *Attorney, Agent, or Firm* — David H. Judson

(57) ABSTRACT

A metal golf club head that allows a user to customize the location of the center of gravity. The metal golf club head comprises a hollow body with a weighting port. The weighting port allows a user to place weighting material inside the hollow body, customizing the location of the center of gravity, the swing weight, the total weight, and the balance of the golf club.

11 Claims, 4 Drawing Sheets

CUSTOMIZABLE CENTER-OF-GRAVITY GOLF CLUB HEAD

CROSS-REFERENCE TO RELATED APPLICATIONS

This application is a continuation of Ser. No. 11/467,139, filed Aug. 24, 2006, now U.S. Pat. No. 8,177,662, which application is a continuation of Ser. No. 11/313,137, filed Dec. 20, 2005, now U.S. Pat. No. 7,189,169, which application is a continuation of Ser. No. 10/043,421, filed Jan. 10, 2002, now U.S. Pat. No. 7,004,852.

BACKGROUND OF THE INVENTION

1. Field of the Invention

The invention relates generally to golf clubs and, more particularly, to a golf club head in which the center of gravity, balance, and weight are customizable and can be altered to suit changing course conditions, weather conditions, and/or other user requirements.

2. Description of Related Art

Golfers have long recognized that they could alter the weight, balance, and performance characteristics by selectively adding weight to club heads. Typically, weight is added by applying thin strips of lead tape with an adhesive backing to the club head. In this manner the swing weight is increased and the center of gravity (CG) is altered to change the dynamics of the head during the swing and, therefore, the ball flight characteristics after contact. The location of the lead tape, however, is generally limited to the back, crown, and/or sole of the club heads where it would best stay affixed and not alter the look of the club, but this limits the adjustability options available to the golfer. For example, the lead tape could not be put on the face of the club to move the CG closer to the front of the club which is more desirable to some golfers who want the club to be easier to "work", i.e., to shape shots both in a left-to-right manner and in a right-to-left manner.

Furthermore, this use of lead tape was generally an additive process whereby the swing weight and total weight of the club was increased, often times negatively effecting other performance characteristics of the club. Some golfers overcame this obstacle by grinding down or using other means to reduce the weight of the club. However, this often damaged the protective finish of the club or the shape and configuration intended by the club designer, negatively affected the after-market value of the club, and was difficult and time consuming for the golfer to adjust.

Furthermore, manufacturers of golf clubs have encountered problems when attempting to manufacture individual clubs to identical specifications because of variances of the individual components themselves and when assembled together. Generally, manufacturers build clubs to a weight at, or slightly below, a targeted weight specification and then add additional weight in the head and/or the shaft to increase the total weight and/or the swing weight to the desired specification. Additional weight is commonly added by pouring lead powder into the bottom of the shaft and sealing the shaft with a cork or other means. Alternatively, lead powder has been mixed with putty, epoxy, or other materials that are inserted into the end of the shaft of the assembled head and shaft to facilitate this final weight adjustment by the manufacturer. This method, however, alters the CG of the club away from the optimal location, adversely effecting performance and feel.

Additionally, a common practice has been to inject a hot melt glue or similar material into a hole in the club head during final assembly to arrive at a prescribed swing weight. The location that the glue puddles and adheres to the inner walls is determined by the orientation of the head while the glue is still hot and fluid. Furthermore, this technique has been used to customize the center of gravity of the club head for specific golfers' needs. The location of the glue, however, is generally limited to one broad area due to the closed process, and once the glue is set, the glue is not adjustable.

Several methods have been attempted to create a golf club that allows the weight, balance, and CG of golf club heads to be altered. One example is disclosed in U.S. Pat. No. 6,254,494 to Hasebe, et al. (hereinafter "Hasebe"), entitled, "Golf club head". The weights, which effect CG location and club head dynamics during the swing and the ball flight after contact, can be changed during manufacturing. Once manufactured, however, the weights can not be altered or be customized for individual needs. Therefore, a club head must be manufactured for each desired weighting configuration.

Another example is disclosed in U.S. Pat. No. 6,248,025 to Murphy, et al. (hereinafter "Murphy"), entitled, "Composite golf club head and method of manufacturing". Murphy discloses a weight strip within a ribbon of the body of the club head. Weights in the form of densified loaded films and/or ribbons of material denser than the primary composite material of the head are added to the internal structure assertedly to increase the forgiveness and playability characteristics, including the energy transfer. Murphy discloses that the location and configuration of the weights can be changed during manufacture to achieve varying characteristics, but, once the weights are added and the club head is completed in manufacturing, the weights can not be altered.

Yet another example is disclosed in U.S. Pat. No. 6,206,790 by Kubica, et al. (hereinafter "Kubica"), entitled "Iron type golf club head with weight adjustment member". Kubica assertedly discloses a weight adjustment member located within a secondary cavity within the back of a cavity back iron golf club head. The weight adjustment member is said to be chosen from a plurality of weight adjustment members to overcome variances in manufacturing tolerances and to adjust golf club swing weights to custom fit various golfers' requirements. The weight adjustment member, however, does not allow the position of the CG to be altered.

Yet still another example is disclosed in U.S. Pat. No. 3,652,094, to Glover (hereinafter "Glover"), entitled, "Golf club with adjustable weighting plugs". Glover assertedly discloses the use of threaded weight plugs to alter the CG. The location of the CG in Glover, however, is limited to the position of the threaded cavities. Similarly, U.S. Pat. No. 5,050,879 to Sun, et al. (hereinafter "Sun"), entitled, "Golf driver with variable weighting for changing center of gravity", assertedly discloses three cavities that are sealed by a cover plate in the sole where weight members can be selectively installed. However, the user's options for the location of the weight members are limited to adjustment between the three predetermined cavities, in the horizontal plane from heel to toe, and near the sole only.

Yet still another example is disclosed in U.S. Pat. No. 6,306,048 to McCabe, et al. (hereinafter "McCabe"), entitled, "Golf club with weight adjustment". McCabe assertedly discloses one or more weight chambers that the golfer uses to adjust the weight and CG of a club to customize it to his or her own needs. A filler material is used to set the weights in position. This method, however, limits the weights and weight changes to the location of the internal weight chamber, and, once the filler material is set, the golfer can no longer adjust the weight or center of gravity.

Therefore, there is a need for a golf club head with a customizable CG that allows the CG to be altered by a golfer and/or the manufacturer.

SUMMARY

This disclosure provides a metal golf club head that allows a user to customize the location of the center of gravity. The metal golf club head comprises hollow-body golf club head with a weighting port that allows the user to access the interior of the hollow-body golf club head. The weighting port allows a user to place weighting material, such as lead tape and the like, inside the golf club head, thereby customizing the location of the center of gravity.

BRIEF DESCRIPTION OF THE DRAWINGS

For a more complete understanding of the present invention, and the advantages thereof, reference is now made to the following description taken in conjunction with the accompanying drawings, in which.

DETAILED DESCRIPTION

Figure 1:
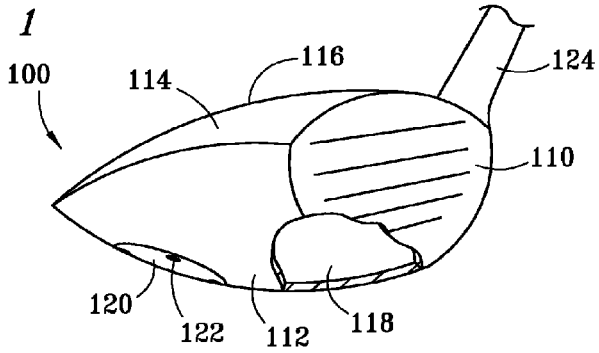
FIG. 1 illustrates a metal golf club head that embodies features of the present invention.
Figure 3:
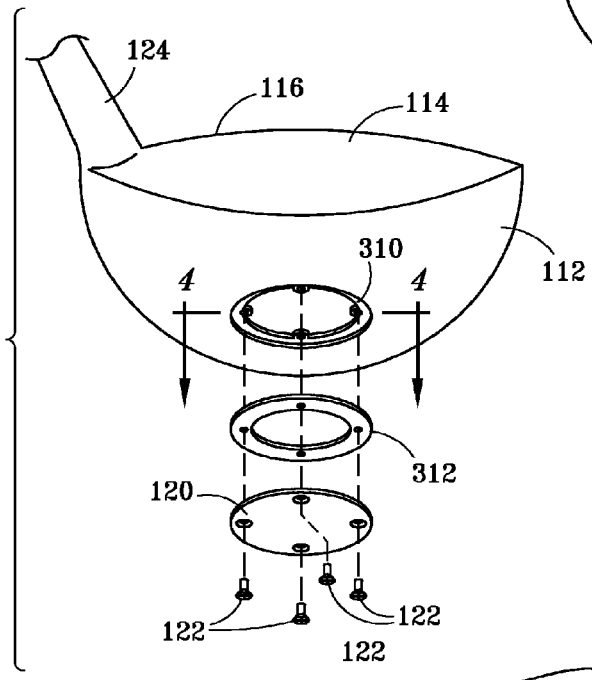
FIG. 3 illustrates a rear view of a metal golf club head with a weighting port cover removed that embodies features of the present invention.

Referring to FIG. 1 of the drawings, the reference numeral 100 generally designates a hollow golf club head embodying features of the present invention. The hollow golf club head 100 generally comprises a face portion 110, an integrated sole and wall portion 112, and a crown portion 114 defining a body 116 with an interior cavity 118. A hosel portion 124 is connected to and/or integrated into the body 116 for receiving a shaft (not shown). Furthermore, a removable, port cover 120, which is described in further detail below with reference to FIG. 3, provides access to the interior cavity 118, thereby allowing the placement of weighting material, such as lead tape, into the interior cavity 118.

In the preferred embodiment, the hollow golf club head 100 comprises a two-piece golf club head. The first piece comprising the integrated sole and wall portion 112 and the face portion 110, including the hosel portion 124. The second piece comprises the crown portion 114, which is welded or otherwise attached to the first piece. Other embodiments, such as a three-piece golf club head, however, may be used as is known in the art.

Figure 2:
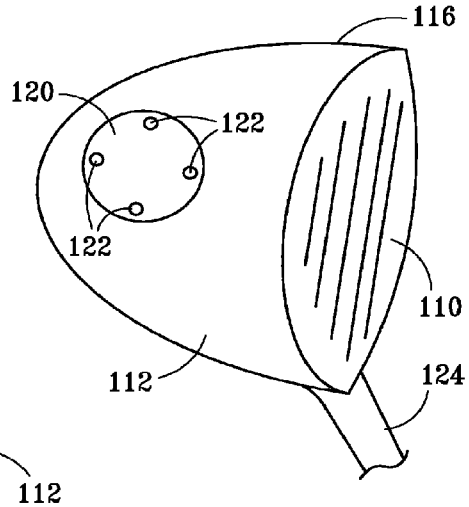
FIG. 2 illustrates a bottom view of a metal golf club head that embodies features of the present invention.

FIG. 2 is a bottom view of the hollow golf club head 100, further illustrating the positioning and sizing of the weighting-port cover 120 in the preferred embodiment. Preferably, the weighting-port cover 120 is positioned on the bottom, i.e., the sole, of the hollow golf club head 100 and away from the face portion 110. Therefore, the weighting-port cover 120 is preferably positioned such that the weighting-port cover 120 is not visible by a golfer when addressing a golf ball. Furthermore, the placement of the weighting-port cover 120 away from the face portion 110 allows placement of weighting material about, or on, the interior side of the face portion 110, and along the heal/toe portions of the hollow golf club head 100, as will be described in greater detail below with reference to FIG. 4.

The weighting port cover 120 is preferably attached to the body 116 via a plurality of flush-mounted bolts 122, and, optionally, may be coated with a friction-reducing material, such as Teflon. In order to reduce the friction, the possibility of the weighting-port cover to "snag" onto grass, thereby affecting the swing path, and the wear and tear, the weighting-port cover 120 is flush-mounted to the integrated sole and wall portion 112 by the plurality of flush-mounted bolts 122.

FIG. 3 illustrates the hollow golf club head 100 with the weighting-port cover 120 removed. The body 116 preferably includes a recessed portion 310 configured for receiving an optional vibration-dampening ring 312 and the weighting-port cover 120. The vibration-dampening ring 312, such as a ring made from foam, rubber, and/or the like, allows the weighting-port cover 120 to be securely fastened, preventing a vibration/rattling noise that may occur as a result of swinging the club and/or striking a ball and sealing the interior cavity from exposure to outside elements, such as sand, water, and/or the like.

The plurality of flush-mounted bolts 122 pass through the weighting-port cover 120 and screw into the recessed portion 310 of the body 116. Alternatively, other methods, such as a weighting-port cover that screws into the body 116, latches, and/or the like, may be used. The preferred embodiment, however, allows for weighting-port cover 120 that is curved to match the contour of the body.

Figure 4:
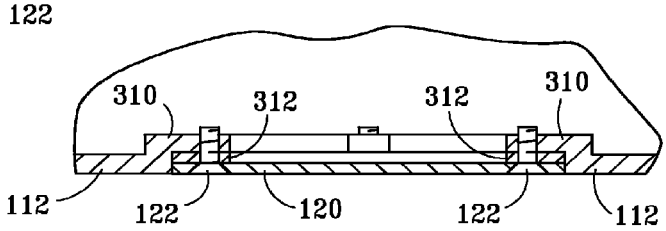
FIG. 4 illustrates a cross-section view with the weighting port cover attached that embodies features of the present invention.

FIG. 4 illustrates a side view of the weighting-port cover 120 attached to the body 116 in accordance the one embodiment of the present invention depicted in FIG. 3. As one skilled in the art will appreciate, the recessed portion 310 allows a smooth contour to be formed by the integrated sole and wall portion 112 and the weighting-port cover 120 when assembled. In an alternative embodiment, however, the weighting-port cover 120 is recessed from the integrated sole and wall portion.

Figure 5:
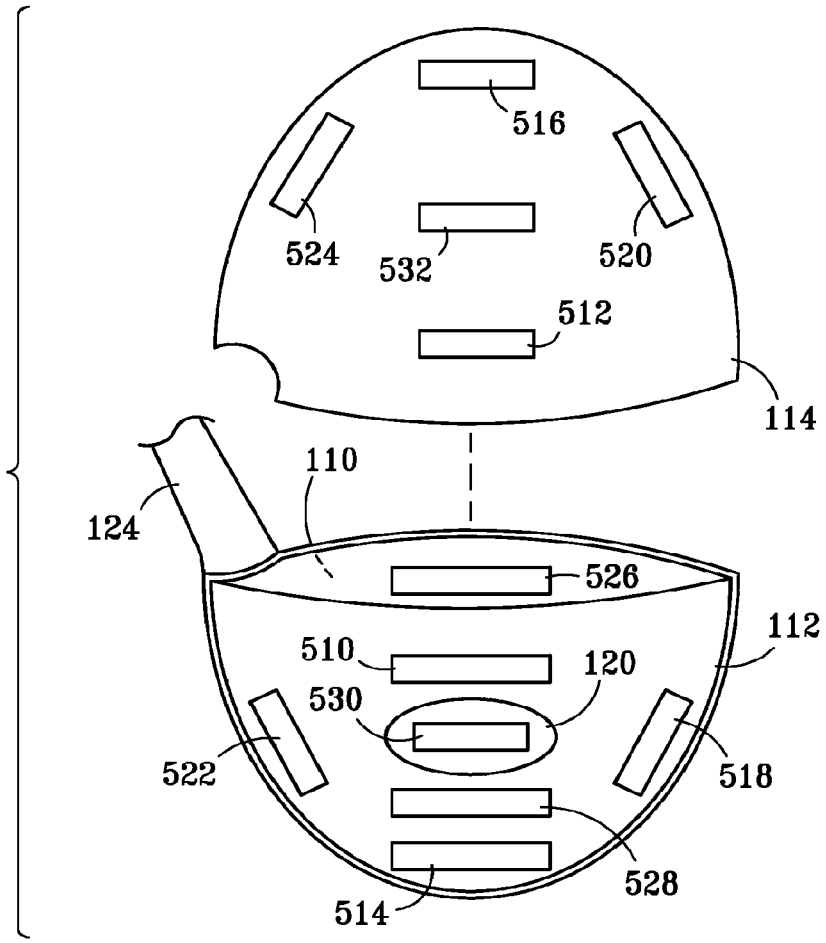
FIG. 5 illustrates a metal golf club head with the crown portion removed to indicate some positions of weighting material.

FIG. 5 illustrates the hollow golf club head 100 with the crown portion 114 separated from the integrated sole and wall portion 112 in order to illustrate potential placements of weighting material in accordance with embodiments of the present invention. The illustrated positions are presented for illustrative purposes only and, therefore, should not limit the present invention in any manner. Furthermore, the positions may be used individually or in combination to further customize the location of the center of gravity.

Weight location 510 illustrates a low-front-center location, which is located on the integrated sole and wall portion 112 adjacent to the face portion 110, that imparts less spin on the ball and a high trajectory, resulting in easier workability (the ability to hit the ball from left to right and vice versa) and more carry (the distance the ball travels in the air).

Weight location 512 illustrates a high-front-center location, which is located on the crown portion 114 adjacent to the face portion, that imparts less spin on the ball and a low trajectory, resulting in easier workability, less carry, and more rolling.

Weight location 514 illustrates a low-back-center location, which is located on the back-center of the integrated sole and wall portion 112, that results in more forgiveness and a high trajectory.

Weight location 516 illustrates a high-back-center location, which is located on the back-center of the crown portion 114, that results in more forgiveness and a low trajectory.

Weight location 518 illustrates a low-back-toe location, which is located on the back-center of the integrated sole and wall portion 112 along the toe, that results in more forgiveness and a high, fading trajectory.

Weight location 520 illustrates a high-back-toe location, which is located on the back-center of the crown portion 114 along the toe, that results in more forgiveness and a low, fading trajectory.

Weight location 522 illustrates a low-back-heel location, which is located on the back-center of the integrated sole and wall portion 112 along the heel, that results in more forgiveness and a high, drawing trajectory.

Weight location 524 illustrates a high-back-heel location, which is located on the back-center of the crown portion 114 along the heel, that results in more forgiveness and a low, drawing trajectory.

Weight location 526 illustrates a forward-center-center location, which is located on the center of the face portion 110, that results in easier workability with a neutral trajectory.

Weight location 528 illustrates a back-center-center location, which is located in the vertical-center of the integrated sole and wall portion 112, that results in neutrally forgiving club head.

Weight location 530 illustrates a low-center-center location, which is located on the center of the integrated sole and wall portion 112, that results in a neutral side-spin with a high trajectory. Note that this location is located on the weighting-port cover 120 for illustrative purposes only. As stated above, the weighting-port cover 120 may be located at any desired location, and a weight may be placed on the weighting-port cover 120 if so desired.

Weight location 532 illustrates a high-center-center location, which is located in the center of the crown portion 114, that results in a neutral side-spin with a low trajectory.

Figure 6:
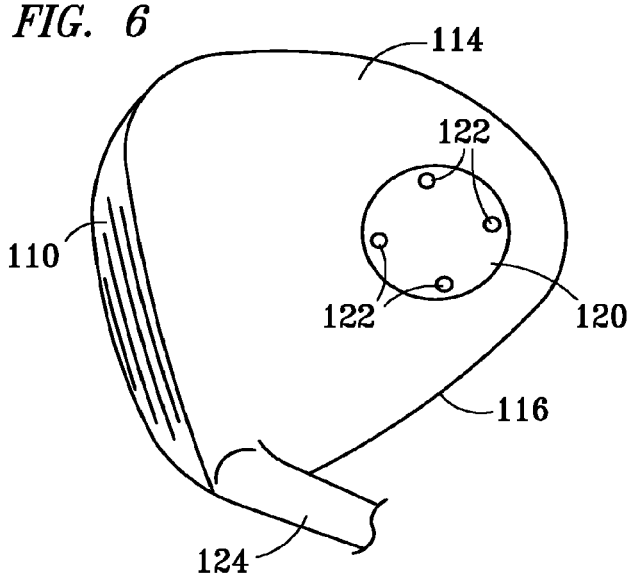
FIG. 6 illustrates a metal driver head embodying features of the present invention.

FIG. 6 illustrates a driver golf club head embodying features of the present invention in which the weighting-port cover 120 is located on the crown portion 114.

Figure 7:
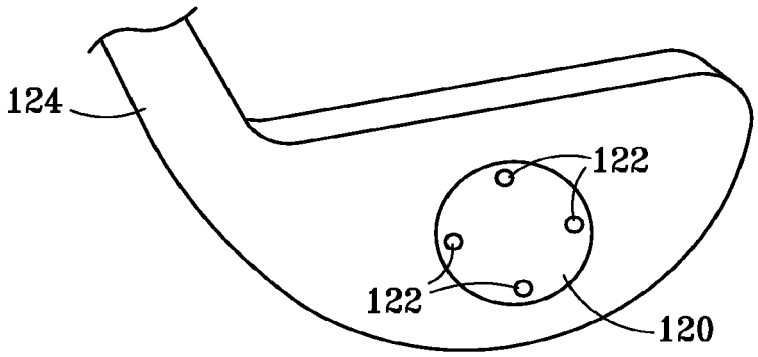
FIG. 7 illustrates a metal iron golf club head embodying features of the present invention.

FIG. 7 illustrates a hollow, iron golf club head embodying features of the present invention in which a weighting-port cover 710 is provided.

Figure 8:
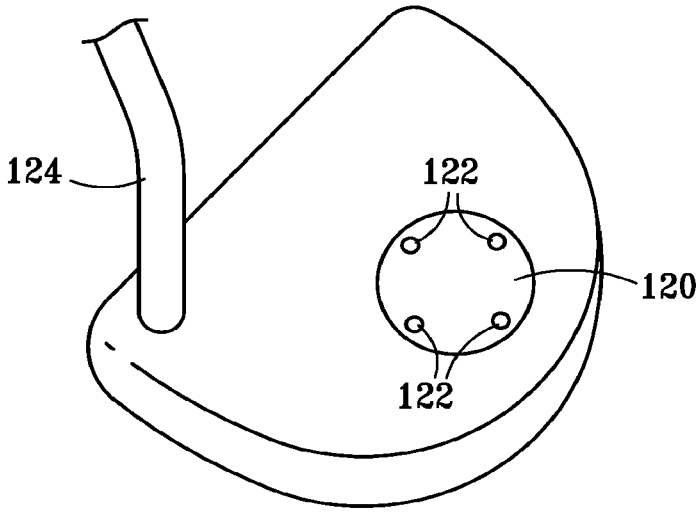
FIG. 8 illustrates a metal putter head embodying features of the present invention.

FIG. 8 illustrates a hollow, putter golf club head embodying features of the present invention in which a weighting-port cover 810 is provided.

It should be noted that the placement and size of the weighting port is shown for illustrative purposes only, and, therefore, should not limit the present invention in any manner.

Figure 9:
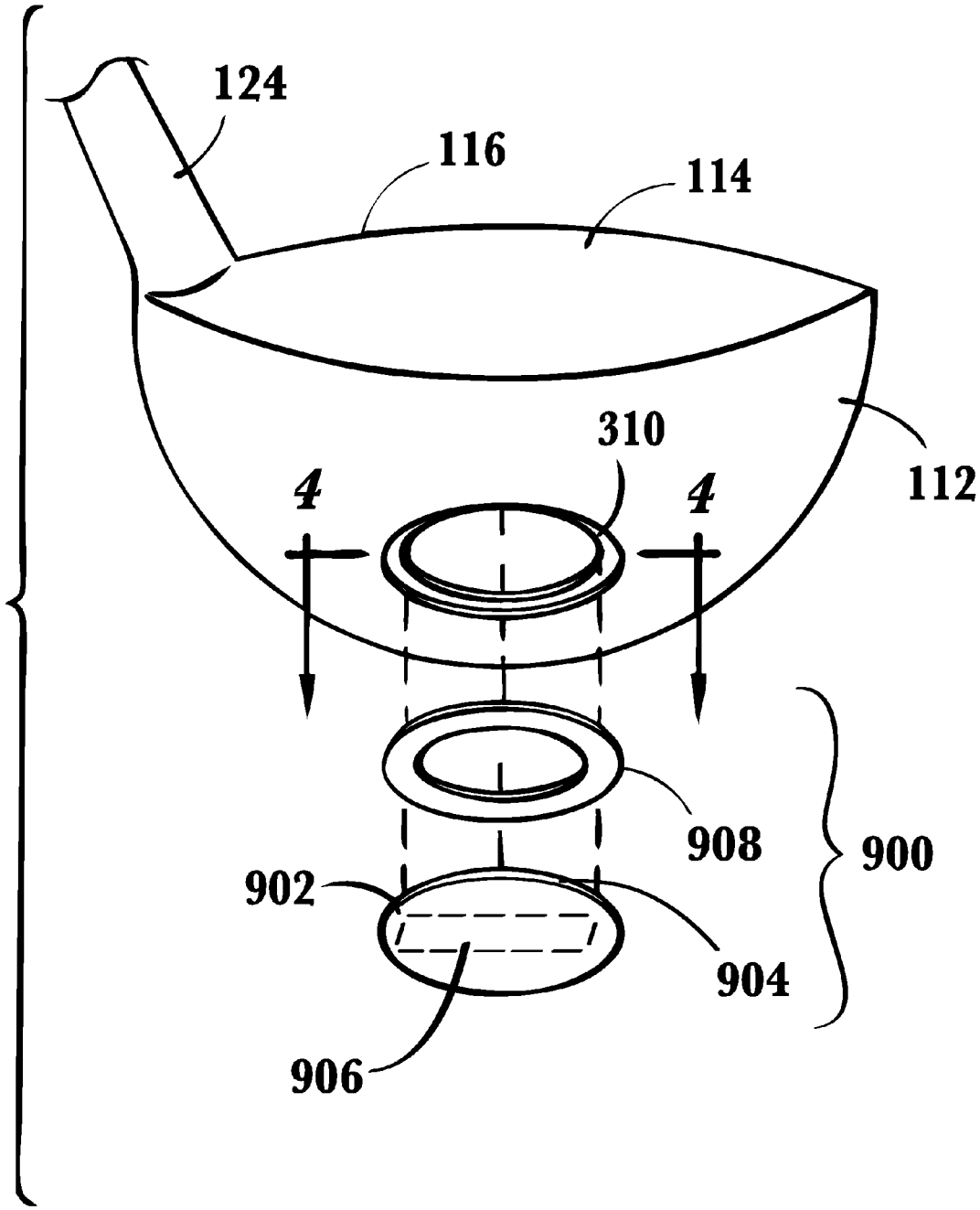
FIG. 9 illustrates an alternative embodiment of a golf club head.

FIG. 9 illustrates an alternative embodiment as described above wherein the weighting-port cover 902 screws into the body. In this embodiment, the cover 902 includes a substantially curved threaded outer perimeter 904. A weight 906 attached to an inner portion of the cover 902 is shown in phantom. Reference numeral 908 is a seal, as has been described. The elements 902, 904, 906 and 908 comprise an assembly.

It is understood that the present invention can take many forms and embodiments. Accordingly, several variations may be made in the foregoing without departing from the spirit or the scope of the invention. For example, the weighting port may be of a different shape and/or there may be a different method of accessing the interior of the club head, such as removing the sole of the club head, the back of the club head, or the like.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

The invention claimed is:

1. A golf club head, comprising:

a hollow club head body with a recessed portion located on a bottom thereof;

a hosel portion integrated with and connected to the head body to receive a golf club shaft;

a removable cover with a curved exterior mounted in the recessed portion;

the removable cover coated with a friction-reducing material;

a ring located between the removable cover and the recessed portion;

the ring sealing a portion of the removable cover and an inner edge of the recessed portion; and a flush-mounted bolt to fasten at least a lower portion of the removable cover plate and the ring into the recessed portion;

a head portion of the bolt being flush with and retaining the removable cover when fastened; and one or more threads of the bolt screwing into the recessed portion and into an interior of the hollow club head body.

2. The golf club head as described in claim 1, further comprising at least one user-adjustable weight for adjusting one of: swing weight, total weight, and a center-of-gravity.

3. The golf club head as described in claim 1, further comprising at least one user-adjustable weight that influences a ball flight characteristic.

4. A golf club head having a body, comprising:

a removable cover with a curved exterior portion, the cover mounted on a bottom portion of the club head and coated with a friction-reducing material;

a foam or rubber ring located between the removable cover and a recessed portion of the body to prevent rattling, the ring being compressed between a portion of the removable cover and an inner edge of a recessed portion of the body, the ring having a hole there-through;

a flush-mounted bolt fastening the removable cover into the recessed portion of the body, a top portion of the bolt being flush with the curved exterior portion, the bolt passing through the hole and including one or more threads screwed into the recessed portion; and a hosel partially integrated with and partially connected to the body to receive a golf club shaft.

5. The golf club head as described in claim 4, further comprising at least one user-adjustable weight for adjusting one of: swing weight, total weight, and a center-of-gravity.

6. A golf club head, comprising:

a hollow club head body formed of a plurality of pieces, wherein a subset of the plurality of pieces are formed of metal and at least two of the pieces are welded together;

a structural arrangement located in a bottom portion of the head;

the structural arrangement defined by (i) a stepped section with side walls descending into a recess, and (ii) an inwardly-extending, outwardly-facing lower wall and, (iii) a threaded bore there-through communicating with an interior cavity;

a removable cover having an outer edge sized and shaped to mate with the structural arrangement when fastened to close access to the interior cavity;

the removable cover being threadably-attached into the structural arrangement and recessed from one or more surrounding club head lower walls to prevent snagging; and a hosel portion integrated with and connected to the head body to receive a golf club shaft.

7. The golf club head as described in claim 6 wherein the port also is located adjacent one of: a heel portion of the club head, and a toe portion of the club head.

8. The golf club head as described in claim 6 wherein the removable cover is weighted.

9. A golf club, comprising:

a hollow metal club head body comprised of a plurality of pieces at least two of which are welded together;

wherein the club head body includes a recessed, stepped structure located on a bottom portion of the head through which a substantially hollow inner cavity is accessed;

a removable, weighted port cover with a curved exterior;

a circular ring assembled between the port cover and a recessed port in the body, the circular ring sealing a portion of the cover and an inner, outwardly-facing edge of the recessed, stepped structure and the port cover when fastened; and one of more threads of the port cover screwed into the recessed, stepped structure of the body, wherein an inner portion of the port cover is exposed to the hollow inner cavity body through a hole in the circular ring and a corresponding hole in the club head body.

10. A golf club, comprising:

a hollow metal club head body comprised of a plurality of pieces at least two of which are welded together;

a structural arrangement located in a bottom portion of the head, the structural arrangement comprising a stepped section with side walls descending into a recess, and an inwardly-extending, outwardly-facing lower wall with a smaller diameter bore there-through communicating with a substantially hollow interior cavity of the head body;

a circular cover with a hole there-through to receive a threaded fastener, the circular cover's outer edge sized and shaped to mate with a recessed portion of the structural arrangement when fastened with a threaded fastener, thereby closing access to the interior cavity via a port formed in the structural arrangement;

the cover being threadably-coupled into the recessed portion;

the cover being recessed from one or more surrounding club head outer walls when installed; and a threaded bolt coupling the circular cover to the recess in the shell thereby sealing the structural arrangement.

11. The golf club head as described in claim 10, wherein the cover is weighted.

* * * * *